United States Patent [19]

Kurtz

[11] Patent Number: 4,490,212

[45] Date of Patent: Dec. 25, 1984

[54] PAPERMAKING MACHINE WITH CENTRAL DEWATERING CYLINDER

[75] Inventor: Rüdiger Kurtz, Immenstaad, Fed. Rep. of Germany

[73] Assignee: Escher Wyss GmbH, Ravensburg/Württ, Fed. Rep. of Germany

[21] Appl. No.: 531,687

[22] Filed: Sep. 13, 1983

[30] Foreign Application Priority Data

Sep. 22, 1982 [CH] Switzerland ..... 5595/82

[51] Int. Cl.[3] ..... D21F 1/60; D21F 11/08

[52] U.S. Cl. ..... 162/298; 162/290; 162/300; 162/303; 162/317; 162/318

[58] Field of Search ..... 162/317, 318, 314, 300, 162/303, 298, 290, 123

[56] References Cited

U.S. PATENT DOCUMENTS

| | | | |
|---|---|---|---|
| 3,531,371 | 9/1970 | Jordansson et al. | 162/298 |
| 3,543,834 | 12/1970 | Stuebe | 162/300 |
| 3,923,595 | 12/1975 | Tokuno | 162/318 |

FOREIGN PATENT DOCUMENTS

| | | | |
|---|---|---|---|
| 2041030A | 9/1980 | United Kingdom | 162/133 |

*Primary Examiner*—William Smith
*Assistant Examiner*—K. M. Hastings
*Attorney, Agent, or Firm*—Werner W. Kleeman

[57] ABSTRACT

The papermaking machine contains an endless inner dewatering band which extends or wraps with its inner side or surface around two series or successively arranged sections of dewatering surfaces. In each wrap-around section thus defined the inner dewatering band is convergently guided or brought together with a portion of a respective endless outer dewatering band towards an infeed throat or gap and a dewatering section following the same. From each dewatering section the associated outer dewatering band is returned towards its related infeed throat or gap. Two headboxes each of which is directed towards a related one of the infeed throats or gaps are provided, so that there are formed two fiber layers or plies which are to be joined. To achieve a compact and simple construction the series or successively arranged sections of the dewatering surfaces are formed at a common dewatering element which is centrally arranged relative to the infeed throats or gaps. The dewatering element may comprise a solid or a water pervious dewatering surface.

6 Claims, 3 Drawing Figures

PAPERMAKING MACHINE WITH CENTRAL DEWATERING CYLINDER

BACKGROUND OF THE INVENTION

The present invention broadly relates to a new and improved construction of papermaking machine.

In its more specific aspects the invention relates to a new and improved papermaking machine comprising an endless water pervious inner dewatering band which extends or wraps with its inner side or surface around at least two series or successively arranged sections of dewatering surfaces. In each wrap-around section thus formed the inner dewatering band is convergently guided or brought together with a respective portion of an endless water pervious outer dewatering band. The infed portion of the outer dewatering band is supplied or infed via an infeed element, and a substantially wedged-shaped infeed throat or gap is thus formed. A dewatering section follows the infeed throat or gap and at that location the outer dewatering band is guided along the outer side or surface of the inner dewatering band. The outer dewatering band is then returned towards the infeed throat or gap by deflecting means. The papermaking machine further comprises at least two stock infeed devices, namely headboxes for forming at least two fiber webs or plies which are to be joined. Each of the headboxes is directed towards a related infeed throat or gap.

In a papermaking machine of this kind as known, for example, from German Patent Publication No. 3,117,463, the series arranged or successive dewatering surfaces are formed at separate rollers. The known arrangement requires a relatively large installation length for the successive headboxes. This is particularly true in designs intended for fabricating a fiber web or ply which comprises more than two layers.

SUMMARY OF THE INVENTION

Therefore, with the foregoing in mind it is a primary object of the present invention to provide a new and improved construction of a papermaking machine which is not afflicted with the aforementioned drawbacks and limitations heretofore discussed.

Another and more specific object of the present invention is directed to the provision of a new and improved papermaking machine designed to possess an even simpler and compacter construction.

Now in order to implement these and still further objects of the invention, which will become more readily apparent as the description proceeds, the papermaking machine of the present development is manifested by the feature that, the series or successively arranged sections of the dewatering surfaces are formed at a common dewatering element which is centrally arranged with respect to the infeed throats or gaps.

The inventive arrangement and design of papermaking machine requires, especially for the inner dewatering band, a relatively small number of locally narrowly limited deflection locations, and thus, affords a particularly protective guiding of the inner dewatering band.

A further design of the papermaking machine according to the invention suitable for the production of paper containing more than two layers or plies and having an advantageously small overall length is achieved in that, the central dewatering element comprises at least one further section of a further dewatering surface in the case of more than two dewatering sections, and the corresponding portion of the outer dewatering band is convergently guided or brought together with the inner dewatering band over the further dewatering section in order to form an additional infeed throat or gap.

Preferably, the dewatering element may comprise a rotatable cylinder. The corresponding arrangement of the headboxes and of the dewatering paths required for the dewatering process results in the use of a cylinder having a relatively large diameter. Such a cylinder, therefore, can also revolve using a drive having a relatively low rotational speed at an advantageously high circumferential speed, which is particularly suitable for tissue paper manufacture.

In a further development of the papermaking machine according to the invention, the dewatering process can be intensified in a simple manner by providing the dewatering element with a device or facility for heating the dewatering surface.

In one specific embodiment of the inventive papermaking machine, which is distinguished by a particularly simplified drive arrangement for the dewatering bands, the portions of the outer dewatering bands which pass through the series arranged or successive dewatering sections can be formed at a common endless band which is guided in spaced relationship from the inner dewatering band between the dewatering sections and forms a loop which is open towards the inner dewatering band. The headbox which is directed towards a downstream arranged one of the infeed throats or gaps is arranged within the open loop.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
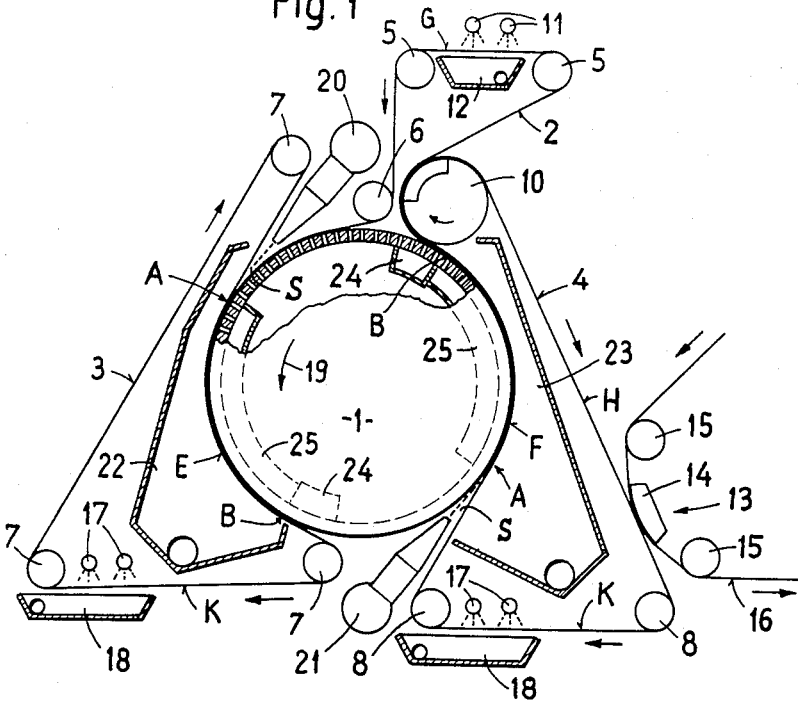
FIG. 1 is a schematic sectional view of a first embodiment of papermaking machine according to the invention.

Describing now the drawings, it is to be understood that only enough of the construction of the papermaking machine has been shown as needed for those skilled in the art to readily understand the underlying principles and concepts of the present development, while simplifying the showing of the drawings. Turning attention now specifically to FIG. 1, there has been schematically illustrated in section therein a first exemplary embodiment of papermaking machine constructed according to the present invention. This papermaking machine according to the showing of FIG. 1 will be seen to contain a dewatering cylinder 1, an inner dewatering band or sieve 2—also referred to as a wire—which is wrapped around the greater portion of the circumference of the dewatering cylinder 1 and two outer dewatering bands or sieves 3 and 4—likewise referred to as wires—. The outer dewatering bands or sieves 3, 4 are guided into respective dewatering sections or portions E, F along a respective wrap-around section of the inner dewatering band or sieve 2 which extends or wraps around the dewatering cylinder 1. The dewatering sections E, F are successively or series arranged in spaced relationship from one another and each forms part of a dewatering surface defined by the dewatering cylinder 1 and extends in the circumferential direction thereof.

Each of the two outer dewatering bands or sieves 3, 4 is guided along the circumference of the dewatering cylinder 1 through the dewatering sections E, F. The inner dewatering band or sieve 2 is guided over two guiding rollers or rolls 5 to form an endless loop within which the guiding rollers 5 are arranged. A further guiding roller 6 is arranged outside of the loop. Each of the dewatering bands or sieves 3 and 4 is guided at respective guide rollers 7 and 8 to form a respective endless loop within which the related guiding rollers 7 and 8 are arranged. Upstream of the dewatering sections E, F, as seen in the running or travel direction of the revolvingly driven dewatering cylinder 1, there is located a run-on or inbound location A. The outer sides or surfaces of the outer dewatering bands or sieves 3, 4 are each convergently guided or brought together with the outer side or surface of the inner dewatering element or sieve 2 at the related run-on or inbound location A in order to form an infeed throat or gap S. At a respective run-out or outbound location B the outer sides or surfaces of the outer dewatering bands or sieves 3, 4 are guided away from the dewatering cylinder 1. Subsequently, each of the outer dewatering elements or sieves 3, 4 is returned to the related infeed throat or gap S.

During its outwardly bound run or travel the outer dewatering band or sieve 3 runs-off from the inner dewatering band or sieve 2, while the outer dewatering band or sieve 4 is guided conjointly with the inner dewatering band or sieve 2 from the run-off or outbound location B over part of the circumference of a separation roll or roller 10. The two dewatering bands or sieves 2 and 4 are separated from each other at the separation roll 10. The inner dewatering band or sieve 2 is returned towards the dewatering cylinder 1 via the guiding or guide rollers 5 and 6. During the return run or travel the inner dewatering band or sieve 2 passes a section G located between the guiding rollers 5 in which spray nozzles 11 are arranged above the dewatering band or sieve 2 in order to clean the same. At this location but below the dewatering band or sieve 2 there is arranged a collecting container or vat 12 for the water effluxing from the spray nozzles 11.

Within a section H which extends downwardly at an angle the outer dewatering band or sieve 4 is guided from the separation roll 10 towards a web pick-up or removal device 13 and subsequently via the guiding or guide rollers 8 towards the infeed throat or gap S of the dewatering section F. The web pick-up or removal device 13 contains a guiding or guide shoe 14 and a felt band 16 which is guided at guiding or guide rollers 15. The guide shoe 14 may contain an open guiding surface and optionally may be connected to any suitable suction apparatus. The outer dewatering bands or sieves 3, 4 also each pass through a section K located between the respective guiding or guide rollers 7 and 8. In each such section K there are arranged spray nozzles 17 for cleaning the outer dewatering bands or sieves 3, 4 as well as a collecting container or vat 18 for the spray water.

Stock infeed devices, namely headboxes 20 and 21 are operatively associated with the infeed throats or gaps S for feeding fiber stock suspension thereinto. By means of each of the headboxes 20 and 21 the fiber stock suspension forms a flat free stock jet which is directed towards the related infeed throat or gap S between the dewatering bands 2 and 3 or 2 and 4, respectively, to form a fiber web or ply. Catch or receiving containers or vats 22 and 23 are arranged within the loops formed by the outer dewatering bands or sieves 3 and 4, respectively, and are intended for draining the sieve water deflected from the dewatering cylinder 1 and formed within the region of the dewatering sections E and F.

During operation the fiber stock suspension which is introduced by the headbox 20 is dewatered to a large extent in the dewatering section E. At the run-out or outbound location B the outer dewatering band or sieve 3 is lifted-off from the formed fiber layer of ply which remains upon the inner dewatering band or sieve 2. Together therewith the fiber web or ply arrives at the next infeed throat or gap S which follows in the revolving direction of the dewatering cylinder 1 and which is generally indicated by the arrow 19. In corresponding manner the fiber stock suspension infed by the headbox 21 is applied to the first fiber layer or ply and is dewatered in the dewatering section F. The fiber web or ply which is formed by the two fiber layers is then guided around the separation roll 10 conjointly with the two dewatering bands or sieves 2, 4. In correspondence with the illustration of FIG. 1 the separation roll or roller 10 may be designed as a suction roll. At the place of separation the inner dewatering band or sieve 2 is lifted-off from the formed fiber web or ply which remains on the outer side of the outer dewatering band or sieve 4. At the web pick-up or removal device 13 the fiber web or ply is transferred to the felt band 16. By means of this felt band 16 such fiber web is then supplied to further conventional processing stations of the papermaking machine which are therefore not here illustrated in particular detail.

According to the illustration of FIG. 1, the dewatering cylinder 1 may comprise an open water pervious shell or jacket surface and optionally may be provided with suction boxes 24 and 25. By virtue of such an arrangement there is enabled an inwardly directed dewatering of the fiber layers which have been formed in the dewatering sections E and F.

Figure 2:
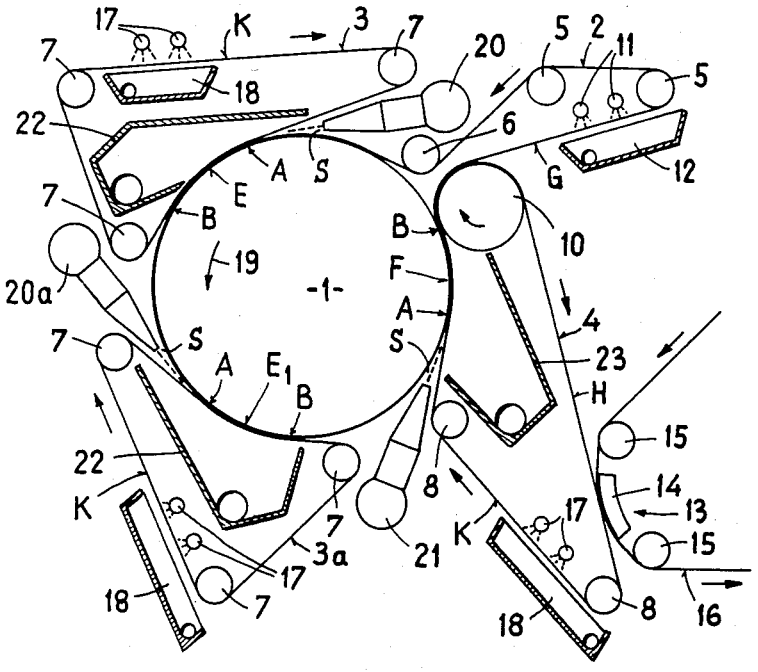
FIG. 2 is a schematic sectional view of a second embodiment of papermaking machine according to the invention.

A second exemplary embodiment of papermaking machine according to the invention is illustrated in FIG. 2. Here the dewatering cylinder 1 and/or the separation roll 10 also may comprise a closed shell surface provided that there prevails a sufficient outwardly directed dewatering of the fiber layers. The papermaking machine of this exemplary embodiment contains a further headbox **20*a* and a third outer dewatering band or sieve 3*a*. The latter forms an additional infeed throat or gap S and an additional dewatering section $E_1$ with the inner dewatering band or sieve 2 between the dewatering sections E and F. In accordance therewith a three-layer fiber web or ply can be formed by the headboxes 20, 20*a* and 21** even within a relatively small space.

Figure 3:
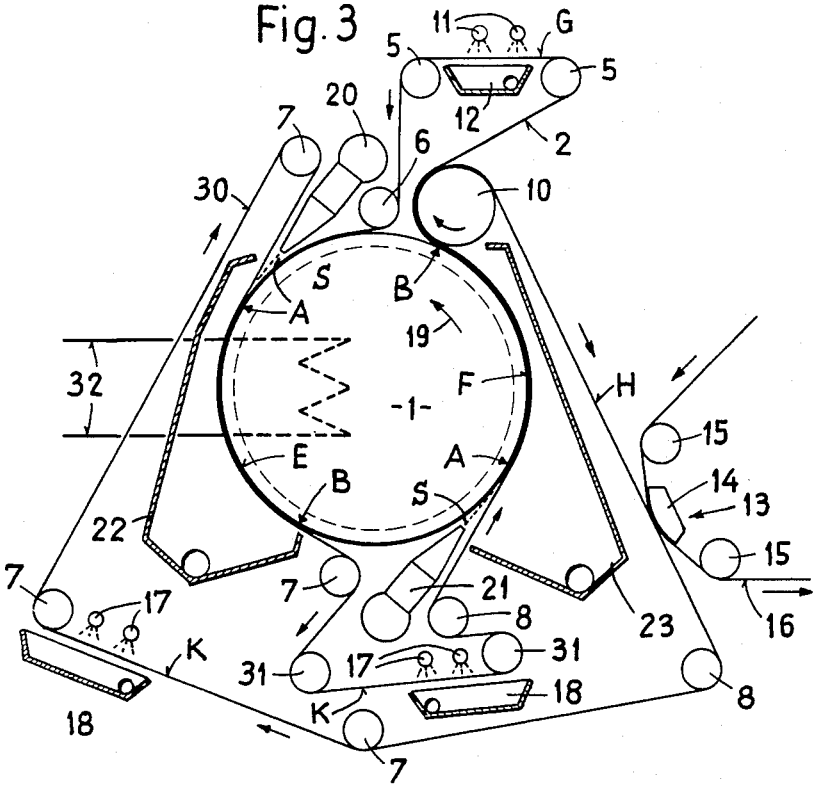
FIG. 3 is a schematic sectional view of a third embodiment of papermaking machine according to the invention.

A third exemplary embodiment of papermaking machine according to the invention is illustrated in FIG. 3. Here only one outer dewatering band or sieve 30 is guided so as to form an endless loop. The single outer dewatering band or sieve 30 is guided over guiding rolls 7, 8 and the separation roll 10 arranged within the band loop, as shown. The outer dewatering band or sieve 30 is guided with its outer side along the inner dewatering band or sieve 2 which extends around the dewatering cylinder 1 at the region of the dewatering sections E and F, as well as at guiding or guide rolls 31 which are arranged in spaced relationship from the dewatering cylinder 1. The headbox 21 and the spray nozzles 17 intended for cleaning of the outer dewatering band or sieve 30 are arranged within a loop formed by the same. The loop of the outer dewatering band or sieve 30 is formed by the guiding or guide rolls 7, 31 and 8 and is open towards the dewatering cylinder 1.

The designs of the papermaking machine as described hereinbefore and including headboxes 20, 20*a*, 21 and dewatering sections E, $E_1$ and F arranged around a central dewatering cylinder 1 generally require the use of a dewatering cylinder which has a relatively large diameter. The dewatering cylinder 1 can be approximately designed like a drying cylinder and may be provided with heating means for heating the dewatering surface. A corresponding design is indicated in FIG. 3 by a schematically represented heating coil 32 which extends into the dewatering cylinder 1.

Instead of sieves or wires also other types of water pervious dewatering bands or the like such as, for example, felt bands may be used.

There are conceivable also other designs in which the series arranged dewatering sections extend along a stationary dewatering element and/or in which stationary guiding members are provided for the dewatering bands or sieves instead of the guiding or guide rolls. Furthermore, in designs including three or more headboxes a common outer dewatering band or sieve may be employed.

While there are shown and described present preferred embodiments of the invention, it is to be distinctly understood that the invention is not limited thereto, but may be otherwise variously embodied and practiced within the scope of the following claims. Accordingly,

What I claim is:

1. A papermaking machine comprising:

an endless water pervious inner dewatering band having an inner side and an outer side;

means defining at least two dewatering surfaces each including a dewatering section;

said dewatering sections being arranged in series;

said inner side of said inner dewatering band extending around said at least two dewatering sections and defining wrap-around sections;

at least one endless water pervious outer dewatering band;

a number of infeed elements for said at least one outer dewatering band for infeeding a respective portion of said at least one outer dewatering band to a respective one of said wrap-around sections;

each of said wrap-around section of said inner dewatering band and a respectively associated portion of said at least one outer dewatering band being convergently guided to define a substantially wedge-shaped infeed gap;

at least two headboxes each directed towards a respective one of said infeed gaps to form fiber layers;

one of said infeed gaps being located downstream with respect to the other of said infeed gaps;

each said dewatering section following a respective one of said infeed gaps;

said at least one outer dewatering band comprising a common endless outer band which is guided along said outer side of said inner dewatering band over each said dewatering section;

deflecting means operatively associated with each said dewatering section for returning said common endless outer band to each said infeed gap;

said common endless outer band being guided in spaced relationship from said inner dewatering band and forming an open loop towards said inner dewatering band between said dewatering sections;

said headbox which is directed towards said downstream located infeed gap being arranged within said open loop;

said series arranged two dewatering sections of said dewatering surfaces being formed at a common dewatering element; and said common dewatering element being centrally arranged relative to said infeed gaps.

2. The papermaking machine as defined in claim 1, wherein:

said means defining said dewatering surfaces forms more than two dewatering sections;

said common dewatering element comprising at least one further section of a further dewatering surface; and a portion of an outer dewatering band being convergently guided over said further section to form an additional infeed gap with said inner dewatering band.

3. The papermaking machine as defined in claim 2, wherein:

said common dewatering element comprises a rotatable cylinder.

4. The papermaking machine as defined in claim 1, wherein:

said common dewatering element comprises a rotatable cylinder.

5. The papermaking machine as defined in claim 1, wherein:

said common dewatering element is provided with heating means for heating each said dewatering surface thereof.

6. The papermaking machine as defined in claim 5, wherein:

said heating means comprises a heating coil.

* * * * *